United States Patent [19]

Zwettler et al.

[11] Patent Number: 4,760,417

[45] Date of Patent: Jul. 26, 1988

[54] ROLL FILM PROCESSOR

[75] Inventors: Ernest Zwettler, Santa Monica; Michael Hersch, Rancho Palos Verdes, both of Calif.

[73] Assignee: Houston Fearless 76, Inc., Carson, Calif.

[21] Appl. No.: 856,702

[22] Filed: Apr. 28, 1986

[51] Int. Cl.[4] ..... G03D 3/13

[52] U.S. Cl. ..... 354/321; 354/322; 354/338

[58] Field of Search ..... 354/299, 320, 321, 322, 354/328, 338, 339; 226/188, 189; 134/64 P, 122 P

[56] References Cited

U.S. PATENT DOCUMENTS

| | | | |
|---|---|---|---|
| 2,488,141 | 11/1949 | Pratt et al. | 134/64 P |
| 2,511,941 | 6/1950 | Pratt et al. | 134/64 P |
| 3,520,461 | 7/1970 | Savela | 226/189 |
| 3,608,807 | 9/1971 | Lee | 226/189 |
| 4,032,943 | 6/1977 | Zwettler | 354/322 |
| 4,130,825 | 12/1978 | Fassano | 354/322 |
| 4,252,429 | 2/1981 | Hope et al. | 226/188 |
| 4,354,755 | 10/1982 | Becheiraz | 134/64 P |
| 4,416,529 | 11/1983 | Kastl | 354/338 |

*Primary Examiner*—A. A. Mathews

*Attorney, Agent, or Firm*—Freilich, Hornbaker, Rosen & Fernandez

[57] ABSTRACT

A roll film processor for developing film wound into a roll. The processor has a plurality of substantially aligned tanks containing processing liquids. A removable film drive module having a "U" shaped section for each tank carries the film along a serpentine path through the tanks. Each "U" shaped section has down path leg for carrying the film into the liquid and an up path leg for carrying the film out of the liquid. The rollers for moving the film are positioned outside the liquid. Opposed "V" shaped grooves guide the edges of the film in the liquid. One of the grooves is on a front portion of the drive module and the other is on a rear portion. If a jam occurs, the film drive module is removed from the processor and opened by removing retainer clips by hand from retainer pins. The grooves are thereby separated allowing removal of the jammed film. Reassembly of the film drive module on the processor is facilitated by latitudinally flexible couplers for the module drive shafts. A combination of paddle agitators and anti-contamination ridges on the down path legs in the wash tanks prevents recontamination of the clean film as it leaves the tanks.

17 Claims, 6 Drawing Sheets

ROLL FILM PROCESSOR

BACKGROUND OF THE INVENTION

1. Field of the Invention

The present invention pertains to the photography art, and more particularly, to an automatic roll film processor.

2. Background Art

Automatic roll film processors typically are large machines having multiple chemical tanks and drying sections for processing the film. The chemicals in the tanks are continuously monitored, supplemented, heated, and/or cooled by auxiliary equipment. The roll film is transported through the various processing stations by means of paired rollers. Rollers are typically provided throughout to control the film including inside the chemical tanks. Drive means for turning the rollers also extend into the tanks. The drives and rollers are therefore subject to malfunctions caused by the chemicals. When a jam of the film occurs, extensive disassembly of the processors is often required.

Smaller roll film processors are also known in the art; e.g. processors manufactured by Pako and Eastman Kodak corporations which use a film transport module constructed to lift out of the chemical processing section for cleaning and removal of jammed film. Work on the film transport module is therefore easier than on similar transport systems in the larger processors because of the easier access and the ability to wash off the module prior to attempting repairs. However, repairs remain time consuming and difficult because the module retains the roller transport system of the larger processors.

SUMMARY OF THE INVENTION

The present invention is directed to an improved portable roll film processor for automatically processing roll film. A removable film drive module is provided for moving the film through tanks containing chemical processing liquids. The film drive module defines an essentially serpentine path for the film including successive "U" shaped sections depending from a common frame member. Each of the "U" shaped sections extends into a different tank and includes a down path leg for carrying the film into the tank and an up path leg for carrying the film out of the tank. All moving parts required to move the film are located above the liquids to minimize maintenance problems.

In accordance with one important aspect of the invention, the film passes through, and is moved by, pairs of opposing rollers which are all located above the liquids. Opposed "V" shaped grooves define a track between the rollers and inside the liquids for guiding the edges of the film along the serpentine film path.

In accordance with another aspect of the invention, an anti-contamination means is positioned in at least one of the "U" shaped sections for slowing the mixing of the liquid adjacent the down path leg with the liquid adjacent the up path leg. Residual liquids from a previous tank are initially washed off the film as it enters the liquid in the new tank. Contamination of the liquid in the new tank is therefore highest around the down path leg. The anti-contamination means retards the mixing to significantly speed up the processing time and improve results.

In a preferred embodiment, a paddle agitator is provided between the down and up path legs to mix the liquid to prevent contaminating concentrations of liquids from previous tanks from collecting. The drive means for the agitator is also located above the liquid to minimize mechanical problems.

In accordance with another aspect of the invention, a slipping reversable take-up reel drive is provided for rewinding the film after processing. The take-up reel drive has clockwise and counterclockwise fixed speed drives and a movable slip drive means for selectively engaging and slipping against one of the fixed speed drives to rotate the reel shaft.

In accordance with another aspect of the invention, the film drive module has a front portion with one of the "V" shaped grooves and a rear portion with the other "V" shaped groove. When the front portion is separated from the rear portion, easy access is provided to any film jammed inside.

In a preferred embodiment, retainer pins and clips hold the front and rear portions together. The retainer clips have finger grip means permitting removal and installation by hand. Disassembly and reassembly of the film drive module may be completed rapidly without any tools.

In accordance with another aspect of the invention, the film drive module is removable for cleaning and disassembly. A slip coupler is provided between a drive shaft on the module and a drive shaft rotating means in the film processor. The coupler is mounted in a flexible mounting means allowing the coupler to engage the drive shaft at positions away from the center of the mounting means.

One of the features of the preferred embodiment is a single air moving means for cooling the processor and supplying an air flow for a film dryer. Cooling air is required because of heat generated by a motor and a liquid heater. The single air moving means moves cooling air over the motor, provides moving air for the film dryer, and cools the tanks.

Another feature of the preferred embodiment is a film cutter for cutting the film off a supply reel when the film drive module has removed all but the inner end of the film from the reel. The cutter has a blade for cutting the film, a blade biasing means, a trigger link for retaining the blade in a cocked position, and a trigger link biasing means normally retaining the trigger link in the cocked position. The trigger link releases the blade when the force of the film drive module drawing the film exceeds the force of the trigger link biasing means retaining the trigger link in the cocked position.

Other features and advantages of the present invention will become apparent from the following detailed description, taken in conjunction with the accompanying drawings, which illustrate, by way of example, the principles of the invention.

DESCRIPTION OF THE PREFERRED EMBODIMENT

Figure 1:
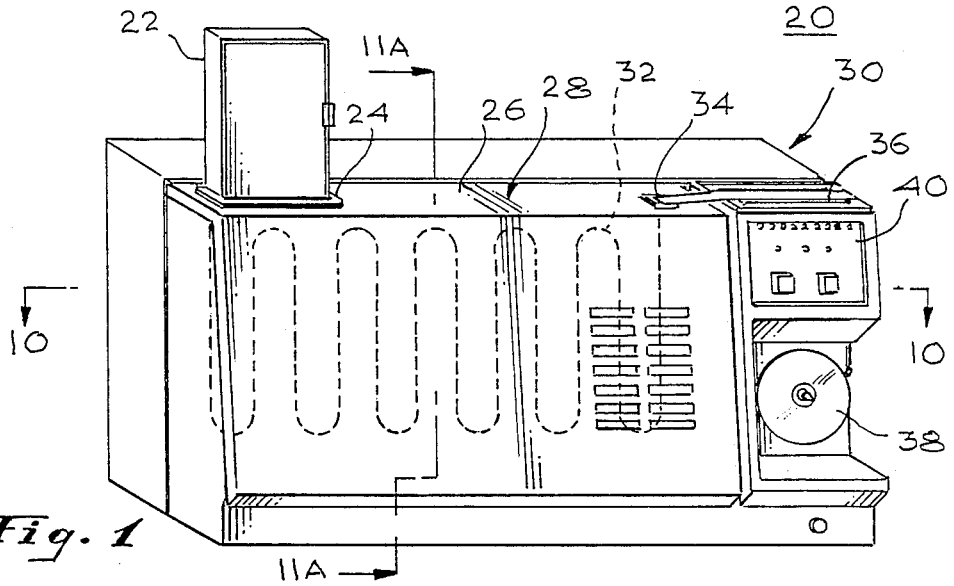
FIG. 1 is a perspective view of a roll film processor of the present invention indicating the film path in a dotted line.

Referring initially to FIG. 1, there is illustrated a perspective view of a roll film processor, generally designated 20, in accordance with the present invention. The exposed roll film to be developed is held on a supply reel inside a cartridge positioned in a removable cassette 22. The cassette 22 is fitted into a cassette retainer 24 in the top 26 of a cover 28 on the processor cabinet 30. The film exits the cassette 22 into a slot in the bottom of the cassette holder 24 to the interior of the cabinet 30. The film passes along an essentially serpentine film path 32, indicated approximately by the dotted line, inside the cabinet 30 passing through various film processing stations and exits from the cabinet 30 in a completely processed condition at a second slot 34. The film then passes across a lighted viewing plate 36 where the results of the processing can be visually monitored. The processed film is then rewound on a take-up reel 38 for storage.

A control panel 40 provides and interface between the operator and an internal microcomputer to control the operation of the processed film counter and chemistry replacement indicator to monitor the condition of the chemicals used during the processing. The chemicals are expended by the processing of film and/or the passage of time. The processed film counter counts the number of film reels processed and also advances with the passage of time. The chemistry replacement indicator is lighted when the set number of reels has been processed and/or when the passage of time has rendered the chemicals no longer effective for the further processing of film.

Figure 2:
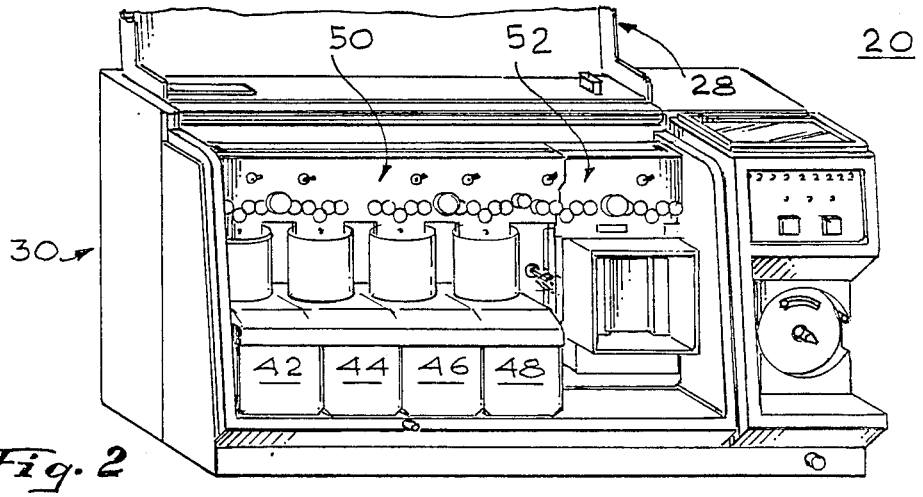
FIG. 2 is a perspective view of the processor with the cover lifted.

FIG. 2 is a perspective view of the processor 20 with the cover lifted exposing a plurality of substantially aligned tanks 42, 44, 46, and 48, each containing a liquid used in the film developing process. As shown, four tanks are provided for a process for black and white film. The first tank 42 contains a developer, the second tank 44 contains a fixer, the third tank 46 contains a chemical for a first wash, and the fourth tank 48 contains a chemical for a second wash. It will be appreciated that additional tanks and sections of the processor 20 may be added for additional steps if desired such as for the development of color film. The film is carried through the tanks by a film drive module 50 and is dried in a film dryer module 52.

Figure 3:
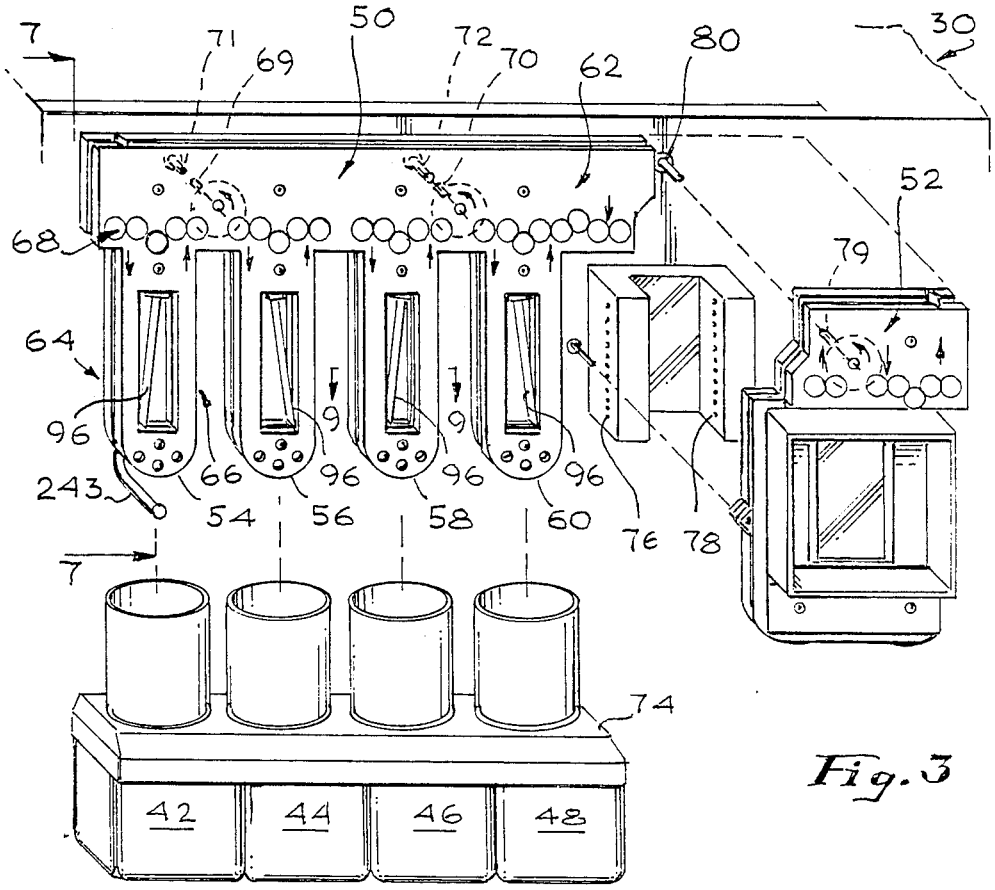
FIG. 3 is an exploded perspective view of the film drive module, tanks, and film dryer module.

FIG. 3 is an exploded perspective view of the film drive module 50, the film dryer module 52, and the tanks 42, 44, 46, and 48 in relation to the cabinet 30. The film drive module 50 is removable to permit the cleaning of the chemicals from the module 50 after use and also to facilitate retrieval of film jammed in the module 50. The film drive module 50 has successive "U" shaped sections 54, 56, 58, and 60 depending from a common frame member 62. Each of the "U" shaped sections 54, 56, 58, and 60 is intended to extend into a different one of the tanks 42, 44, 46, and 48. Each section 54, 56, 58, and 60 includes a down path leg 64 for carrying the film into the tank and an up path leg 66 for carrying the film out of the tank. Also included on the film drive module 50 is a film mover means 68 positioned outside and above the liquid for moving the film as shown more clearly in the following figures. Drive shafts 69 and 70 on the film mover means 68 connect with slip couplers 71 and 72 of a drive shaft rotating means in the cabinet 30. Prior to assembly, the four tanks 42, 44, 46, and 48, which are connected together by a skirt 74 for ease of assembly and transportation, are positioned on the cabinet 30 and the "U" shaped sections 54, 56, 58, and 60, respectively, are fitted through the tops of the tanks.

The film dryer module 52 is also removable from the cabinet 30 to permit cleaning and to facilitate retrieval of jammed film. The film dryer module 52 has two "U" shaped sections similar in structure to the "U" shaped sections 54, 56, 58, and 60 of the film drive module 50 that carry the film around hot air outlets 76 and 78 on the cabinet 30. A drive shaft 79 on the film dryer module 52 receives power from the drive shaft rotating means in the cabinet 30 through a slip coupler 80.

Figure 4:
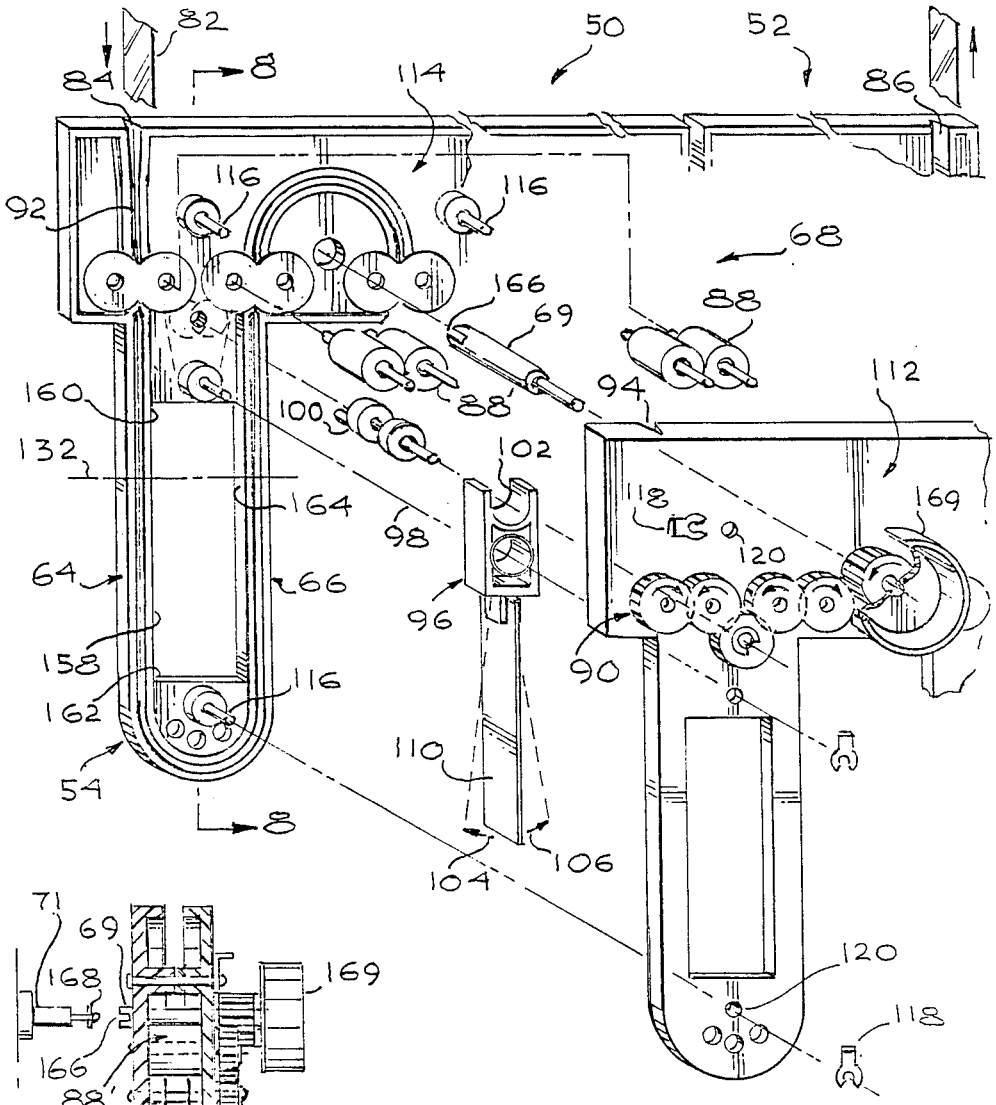
FIG. 4 is an enlarged exploded perspective view of a portion of the film drive module.

FIG. 4 is an enlarged exploded perspective view of a portion of the removable film drive module 50. The film 82 enters the film drive module 50 through a first slot 84 and exits the film dryer module 52 at a second slot 86. The film mover means 68 has a pair of opposing rollers 88 and 88' at the top of each down path leg 64 and each up path leg 66. The film 82 passes between the pair of rollers 88 with one of the rollers contacting one side of the film and the other roller contacting the other side. The rollers 88 are driven by a train of gears 90. As the rollers 88 turn, the film 82 is pushed along. Opposed "V" shaped grooves 92 and 94 define a track between the rollers 88 for guiding the two edges of the film 82 along the serpentine film path 32 illustrated in FIG. 1. In this manner, all of the moving parts of the film mover means 68 are positioned above any liquids in the tanks. Only the film 82 moves in the liquid.

The film drive module 50 incorporates a paddle agitator 96 fitted between the down and up path legs 64 and 66 of each of the "U" shaped sections 54, 56, 58, and 60 (FIG. 3) for mixing the liquids in the tanks. The paddle agitator 96 is fitted on an agitator axle 98. The paddle agitator 96 is oscillated by an agitator drive means in the form of a cam 100 driven by the power train 90. The cam 100 moves in a slot 102 in the end of the paddle agitator 96 swinging a paddle portion 110 in the liquid as indicated by the arrows 104 and 106. No other moving parts are in the liquid thereby reducing maintenance problems.

The film drive module 50 has a front portion 112 with the "V" shaped groove 94 and a rear portion 114 with the "V" shaped groove 92. When the front portion 112 is separated from the rear portion 114 as illustrated in FIG. 4, any film 82 jammed inside the module 50 is easily removed.

Figure 5:
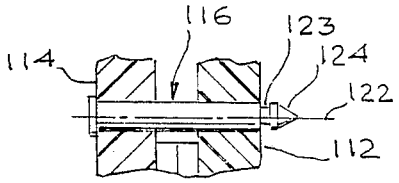
FIG. 5 is an enlarged side elevational view of a retainer pin.
Figure 6A:
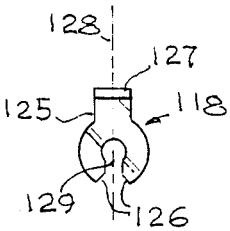
FIG. 6A is an enlarged top plan view of a retainer clip.
Figure 6B:
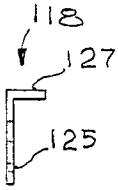
FIG. 6B is a side elevational view of the retainer clip.

FIG. 5 is an enlarged side elevational view of a retainer pin 116. FIGS. 6A and 6B are an enlarged top plan view and side elevational view of a retainer clip 118 for the retainer pin 116. The front and rear portions 112 and 114 of the film drive module 50 in FIG. 4 are held together by a plurality of retainer pins 116 and retainer clips 118. The retainer pins 116 are coupled to the rear portion 114 and pass through holes 120 in the front portion 112. Each pin 116 has a pin axis 122, a pin outer surface 123, and a head 124 on its outer end. Each retainer clip 118 has a body member 125 with two opposed compression shoulders 126 extending from the first end and a finger grip means in the form of a thumb tab 127 coupled to the second end. The axis 128 of the clip 118 passes through the first and second ends and is perpendicular to the pin axis 122 when the clip is installed on the retainer pin 116. The two compression shoulders 126 are spaced from the clip axis 128 and define a clip opening 129 along the clip axis for gripping the outer surface of the pin 123. The head 124 on the pin 116 prevents the clip 118 from pulling off the pin 116 parallel to the pin axis 122. The thumb tab 127 is positioned on the second end perpendicular to the clip axis 128 and is parallel to the pin axis 122 when the clip 128 is installed on the pin 116. The result is a clip that is readily installed on and removed from the pin 116 from the side by means of the thumb tab 127. On the other hand, removal over the head 124 of the pin 116 is difficult. The pins 116 and clips 118 allow the film drive module 50 to be readily opened by hand for servicing without any tools while securely holding the front and rear portions 112 and 114 together during use.

Figure 7:
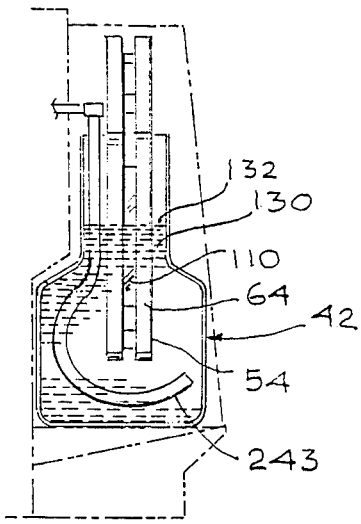
FIG. 7 is a sectional view along the line 7—7 of FIG. 3.

FIG. 7 is a sectional view along the line 7—7 of FIG. 3 with the "U" shaped section 54 inserted in the tank 42. A liquid 130 is inside the tank 42. Only the down path leg 64, the up path leg, and the paddle portion 110 of the agitator 96 reach below the surface 132 of the liquid 130. As shown in FIG. 4, the left pair of rollers 88 above the down path leg 64 pushes the film down along the "V" shaped groove 84 below the surface of the liquid represented by the line 132. The right pair of rollers 88' pulls the film up along the "V" shaped groove 84 out of the liquid. Thus, all of the moving parts of the film drive module 50 other than the paddle portion 110 are located above the surface 132 while the film is pushed and pulled in a controlled loop through the liquid 130.

FIGS. 4 and 7 are representative of the similar "U" shaped sections 56, 58, and 60 in the other tanks 44, 46, and 48 shown in FIG. 3. A different photographic development processes takes places in each one. In each, the process begins when the film moves below the surface of the liquid and substantially ends when the film leaves the liquid. The process continues at a greatly reduced level until the film moves below the surface of the liquid in the next tank.

In each tank the liquid must be stirred in order to mix the chemical adjacent the film with other liquid in the tank in order to obtain a uniform result as the processing of the roll film continues. Otherwise, depleted chemical concentrations tend to surround the film in the developer and fixer tanks 42 and 44 and to concentrate around the film in the two wash tanks 46 and 48. In some film processors, a propeller is provided rotating on a shaft parallel to the down and up path legs to stir the liquid. The propeller creates a vertical flow pattern in the tank from the top to the bottom in the center and from the bottom to the top around the sides with all of the liquid in the tank being cycled constantly. The paddle agitator 110 of the present invention, on the other hand, stirs the liquid gently across horizontal levels.

Figure 8:
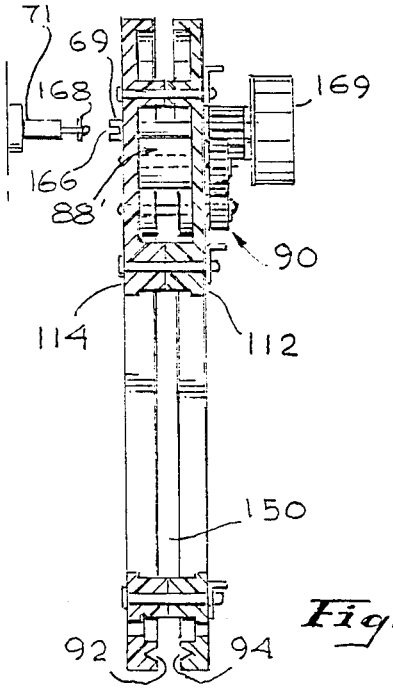
FIG. 8 is a sectional view along the line 8—8 of FIG. 4 with the front and rear portions assembled.

FIG. 8 is a sectional view along the line 8—8 of FIG. 4 with the front and rear portions 112 and 114 assembled. A space 150 remains between the front and rear portions 112 and 114 adjacent the "V" grooves 92 and 94 allowing the liquid in the tank to contact the film located in the "V" grooves. Similar spaces allow the liquids to reach the film between the front and rear portions 112 and 114 on all of the other down and up path legs 64 and 66 of all the "U" shaped portions 54, 56, 58, and 60 shown in FIG. 3 except for the inner sides of the down path legs on the "U" shaped sections 58 and 60 in the chemical wash tanks 46 and 48.

Figure 9:
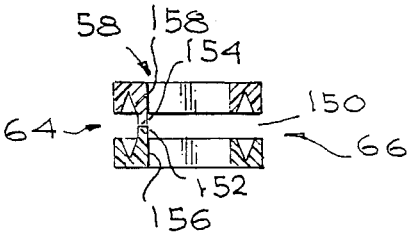
FIG. 9 is a sectional view along the line 9—9 of FIG. 3.

FIG. 9 is a sectional view along the line 9—9 of FIG. 3 illustrating the blockage of the space 150 on the inner sides 156 and 158 of the down path leg 64 of the "U" shaped section 58 by an anti-contamination means in the form of a front ridge 152 and a rear ridge 154. The down path leg 64 of the "U" shaped section 60 has similar ridges. The ridges 152 and 154 extend from the top of the down path legs to the bottoms. Using the "U" shaped section 54 in FIG. 4 as being representative of the "U" shaped section 58, the ridges extend from a point 160 above the surface of the liquid 132 to a point 162 near the bottom of the inner side 158.

The anti-contamination ridges 152 and 154 slow the mixing of the wash chemicals and contaminating chemicals from the previous tanks adjacent the down path leg 64 with the liquid adjacent the up path leg 66. Without the ridges 152 and 154 the chemicals from the previous tank remaining on the film would wash off and concentrate on the surface 132 adjacent the down path leg 64. The concentration of contaminating chemicals would rapidly move across the liquid near the surface 132 to the up path leg 66 where the film cleaned in the liquid would be recontaminated. The anti-contamination ridges 152 and 154 cause the chemicals entering the liquid on the film to be drawn down into the tank where the chemicals are eventually permitted to exit into the liquid at the point 162 far removed from the point 164 where the clean film exits the liquid. The paddle agitator 96 contributes to the cleansing processing by mixing the liquid only in horizontal layers as noted above. Thus, only slow mixing occurs between the top and bottom of the liquid in the tank. In addition, the paddle agitator 96 mixes the liquid minimally at the surface 132 because the arc of the agitator 96 is minimal at this location. Any contaminating chemicals that might be present near the surface 132 at the down path leg 64 are, therefore, not significantly moved by the action of the agitator 96 toward the up path leg 66. On the other hand, the agitator 96 moves widely as indicated by the arrows 104 and 106 near the point 162 at the bottom of the liquid to rapidly dissipate the chemical concentrations at this level.

Power for operating the film drive module 50 by rotating the gear train 90 illustrated in FIGS. 4 and 8 is provided through the drive shaft 69. The drive shaft 69 is hollow in the center and has shaft slots 166 for engaging with a pin 168 in the slip coupler 71 from the drive shaft rotating means. The opposite end of the drive shaft 69 has a knob 169 allowing the gear train 90 to be turned by hand to release film jammed in the film drive module 50 and to facilitate cleaning of the pairs of rollers 88 and 88'.

Figure 10:
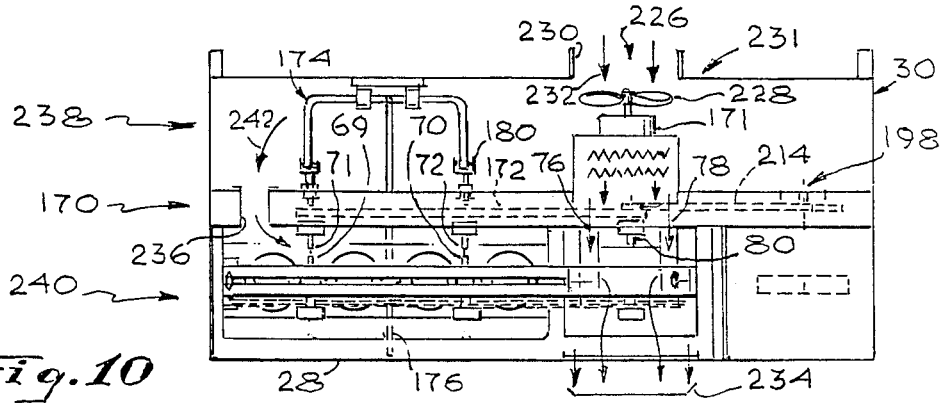
FIG. 10 is a sectional view along the line 10—10 of FIG. 1.

FIG. 10 is a sectional view along the line 10—10 of FIG. 1 illustrating the drive shaft rotating means 170. A motor 171 drives a roller chain 172 which in turn rotates the slip couplers 69, 70, and 80. When the film drive module 50 is to be removed from or inserted into the cabinet 30, the couplers 69 and 70 are retracted into the cabinet by means of a coupler retractor 174 operated by a control shaft 176. When the control shaft 176 is pulled out of the cabinet 30, the couplers 69 and 70 are drawn into the cabinet. When the control shaft 176 is pushed into the cabinet 30, the couplers 69 and 70 extend from the cabinet 30.

Figure 11A:
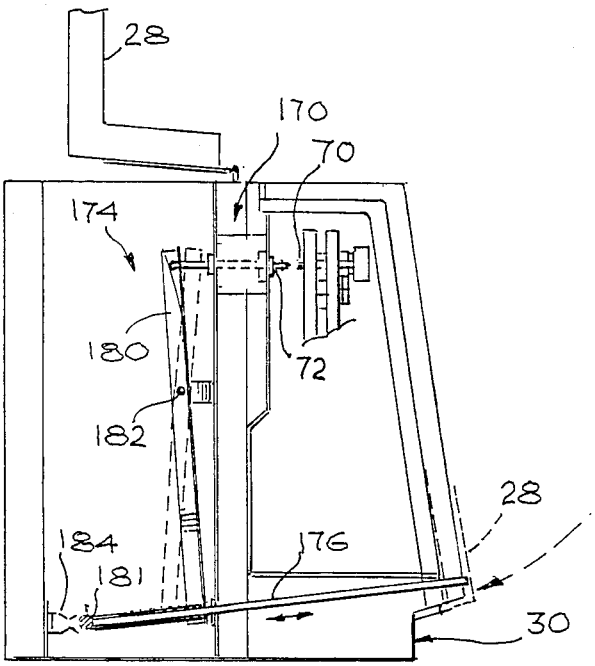
FIG. 11A is a sectional view along the line 11A—11A of FIG. 1.
Figure 11B:
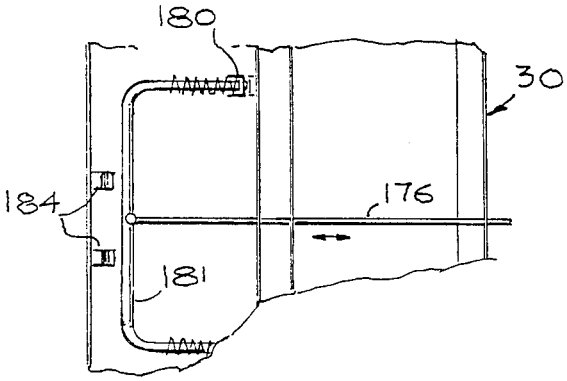
FIG. 11B is a sectional view of the top of the control shaft.

FIG. 11A is sectional view of the drive shaft rotating means 170 along the line 11A—11A of FIG. 1. The movement of the coupler 72 is controlled by the coupler retractor 174. The in and out action is achieved by means of a coupler rocker 180. The control shaft 176 projects through the cabinet 30 into a crossbar 181 connecting to the bottom of the coupler rocker 180. FIG. 11B is a sectional view of the control shaft 176 and the crossbar 181 rotated 90° from the view in FIG. 11A. The rocker 180 is coupled to the cabinet 30 and rotates on an axle 182. When the bottom of the rocker 180 is pushed toward the back of the cabinet 30, the top of the rocker 180 moves toward the front of the cabinet 30 extending the coupler 72 from the front. When the bottom of the rocker 180 is pulled toward the front of the cabinet 30, the top of the rocker 180 moves toward the back pulling the coupler 72 inside. At the end of the travel of the shaft 176 into the cabinet 30, the crossbar 181 engages a clip 184 locking the coupler 72 in an extended position from the cabinet. Positioning of the coupler 72 in the extended position to engage the drive shaft 170 is automatic when the door 28 is closed on the cabinet 30. As the door 28 is closed, the door pushes the control shaft 176 toward the back of the cabinet 30 locking the crossbar 181 in the clip 184.

Figure 12:
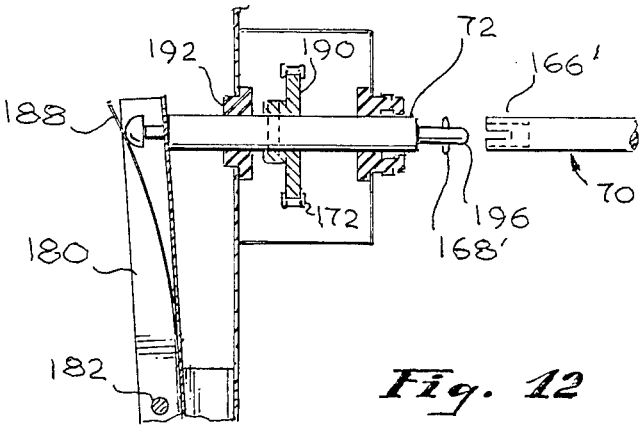
FIG. 12 is an enlarged sectional view of the top of the rocker.

FIG. 12 is an enlarged view of the top of the rocker 180 of FIG. 11A. When the control shaft 176 (FIG. 11A) is pushed into the cabinet 30, the coupler rocker rotates about the axle 182 moving the coupler 72 toward the front of the cabinet. When the coupler 72 is initially pushed forward, the drive shaft slots 166' of the drive shaft 70 may not be properly aligned to engage the drive pin 168'. A leaf spring 188 pressing against the opposite end of the coupler 72 allows the coupler to remain retracted until the coupler is rotated slightly allowing the drive pin 168' to engage the drive shaft slots 166'. The coupler 72 is rotated by a sprocket 190 that carries the roller chain 172 illustrated in FIG. 10. The coupler 72 is mounted in a rubber bushing 192. The bushing 192 normally holds the coupler 72 in a central position. However the bushing 192 is relatively soft permitting the coupler 72 to move and couple with the drive shaft 70 at positions away from the central position. The combination of the roller chain 172, the sprocket 190, the rubber bushing 192, the leaf spring 188, and the rounded head 196 of the coupler 72 provide a latitudinally flexible mounting means for the coupler 72 permitting effective operation of the drive shaft rotating means 170 at positions significantly away from the ideal central position otherwise provided by the bushing 192. In comparison, other roll film processors having removable film drive modules permit only latitudinal movement of the coupler. Greater difficulty is therefore frequently experienced in assembling the module on the processor.

Figure 13:
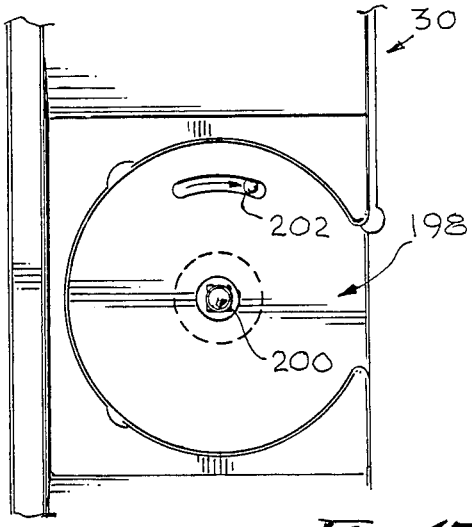
FIG. 13 is a front elevational view of a take-up reel drive.

FIG. 13 is a front elevational view of a take-up reel drive 198 for the take-up reel 38 illustrated in FIG. 1. The reel 38 is positioned on a take-up reel shaft 200. The take-up reel drive 198 winds the film into a roll at the end of the processing procedure. The drive 198 rotates in either the clockwise or counterclockwise direction depending upon the position of a reel control 202. The drive 198 slips during operation in order to assure constant collection of the film as the diameter of the film on the reel 38 increases.

Figure 14:
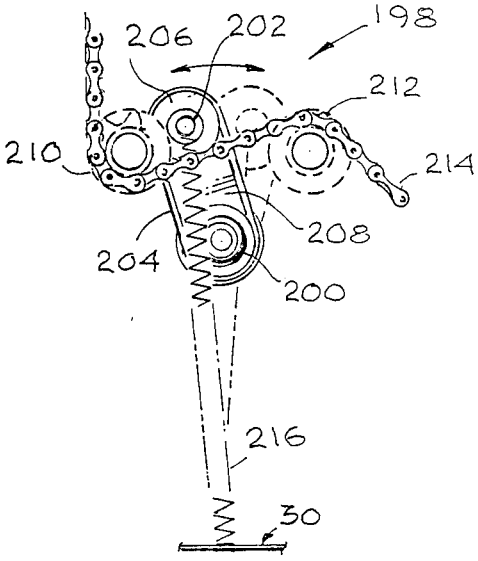
FIG. 14 is a back elevational view of the take-up reel drive.

FIG. 14 is a back elevational view of the take-up reel drive 198. The take-up reel shaft 200 is driven by a belt 204 coupled to a movable pulley 206 mounted on an arm 208 that swivels about the take-up reel shaft. The belt 204 rests against either a clockwise fixed speed drive 210 or a counterclockwise fixed speed drive 212 as indicated the shadow outline and determined by the reel control 202 (FIG. 13). The fixed speed drives 210 and 212 are driven by a roller chain 214. The roller chain 214 is driven by the motor 171 illustrated in FIG. 10. A reel spring 216 maintains the belt 204 against the desired drive 210 or 212 and allows the belt to readily slip against the selected drive to drive the reel shaft 200 at gradually decreasing speeds as the film wound on the reel 38 (FIG. 1) increases in diameter. The belt 204, movable pulley 206, arm 208, and reel spring 214 thereby provide a reversable slipping drive means for rotating the take-up reel 38 illustrated in FIG. 1.

Figure 15:
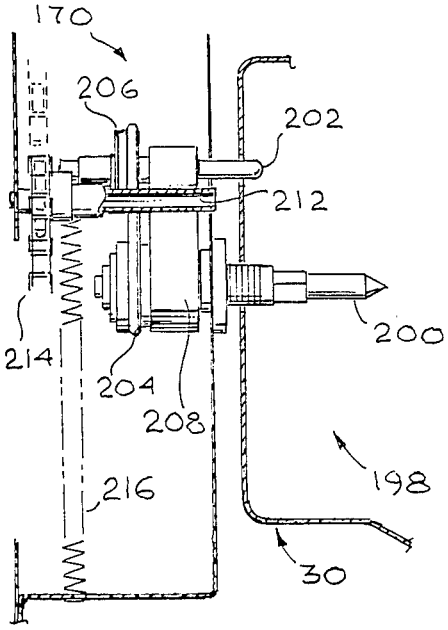
FIG. 15 is a sectional view along the line 15—15 of FIG. 13.

FIG. 15 is a side view of FIG. 14 of the take-up reel drive 198. The belt 204 drives the reel shaft 200 and is positioned against the counterclockwise drive 212 by the reel control 202. The reel spring 216 maintains the arm 208 and movable pulley 206 in the desired position to keep the belt 204 slipping against the drive 212.

Returning to FIG. 10, this figure also illustrates the air flow through the roll film processor 20. The processor 20 has a single air moving means 226 for the various heating and cooling requirements provided by a fan 228 on the motor 171 and the structure of the cabinet 30 and the cover 28. The fan 228 draws air into the cabinet 30 through an inlet 230. Forced air is primarily used by a film dryer means 231 to dry the film through the hot air outlets 76 and 78 in the cabinet 30 as indicated by the arrows 232. The film is rapidly dried by the air and the air is exhausted from the processor 20 through an exhaust outlet 234. A cooling aperture 236 is provided between the back chamber 238 and the tank chamber 240 to allow the fan 228 to blow air into the tank chamber 240 to cool the tanks 42, 44, 46, and 48 as indicated by the arrows 242. Cool air may be required in the tank chamber 240 because of a liquid heater means 243 in the first tank 42 shown in FIGS. 3 and 7. Air from the fan 228 is also utilized to cool the motor 171.

Figure 16:
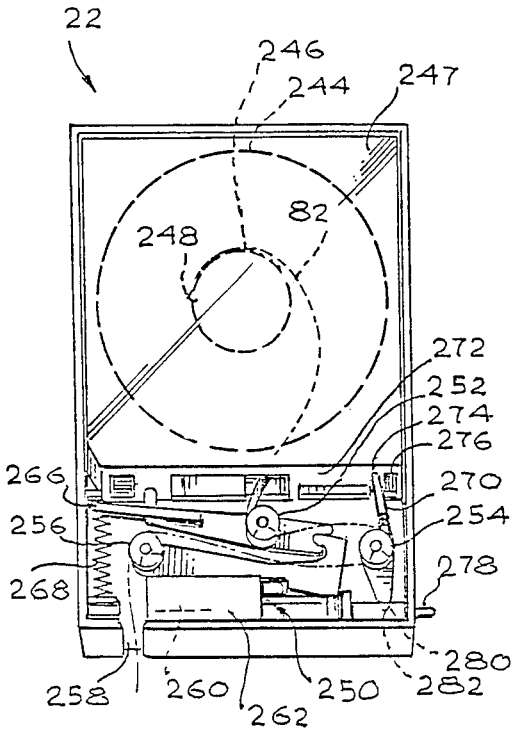
FIG. 16 is an enlarged perspective view of a cassette with the cover removed.
Figure 19:
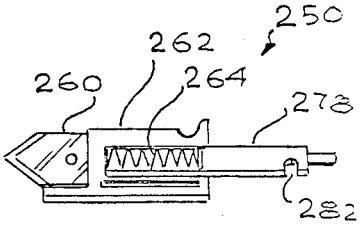
FIG. 19 is a bottom plan view of the blade and blade holder.

FIG. 16 is an enlarged perspective view of the cassette 22 of FIG. 1 with the cover removed. Unprocessed roll film 82 is held on a supply reel 244 having an axle 246 inside a cartridge 247. The film 82 has an inner end 248 coupled to the axle 246. In order to avoid jamming of the roll film processor 20, a film cutter 250 is provided in the cassette 22 for cutting the film 82 from the axle 246 when the film drive module 50 illustrated in FIG. 3 draws the film 82 from the cartridge 247 to the inner end 248. In FIG. 16, the cartridge 247 has been inserted into the cassette 22 and the end of the film 82 wound around first, second, and third capstans 252, 254, and 256, respectively, and out a cassette slot 258. As shown in FIG. 19, the film cutter 250 includes a blade 260, a blade holder 262, and a blade biasing means 264. The blade biasing means 264 normally biases the blade 260 against the film 82. FIG. 19 is a bottom plan view of the blade holder 262. The blade holder 262 is rotated approximately 90° and is visible at the bottom of the cassette 22 in FIG. 16. The blade 260 is drawn inside the blade holder 262 adjacent the cassette slot 258 in a cocked position and is not visible. The blade biasing means 264 is also hidden inside the blade holder 262.

The axle of the first capstan 252 serves as an axle for a trigger link 266 that holds the blade 260 cocked inside the blade holder 262. A trigger link biasing means 268 normally keeps the trigger link 266 holding the blade 260 in the cocked position. The trigger link 266 is tripped when the cartridge 247 physically moves down against the left end of the trigger link 266 with a force greater than the force of the biasing means 268. The blade is then released cutting the film 82. However, as shown in FIG. 16 the cartridge 247 cannot move down against the trigger link 266 because of an enable link 270 that presses against the bottom 272 of the cartridge 247. The cartridge 247 can move down against the trigger link 266 and trip the blade 260 only when the first end 274 of the enable link 270 is positioned outside a slot 276 in the bottom 272 of the cartridge 247. The position of the enable link 270 is determined by the position of a plunger means 278 extending from the end of the blade holder 262 as shown in FIG. 19. The second end 280 of the enable link 270 fits into a slot 282 in the plunger means 278. The blade biasing means 264 normally biases the plunger means 278 outside the cassette 22 as shown in FIG. 16. In this position, the first end 274 of the enable link 270 presses against the bottom 272 of the cartridge 247 providing a safety keeping the blade 260 in the cocked position even if the cassette 22 should be accidently dropped.

Figure 17:
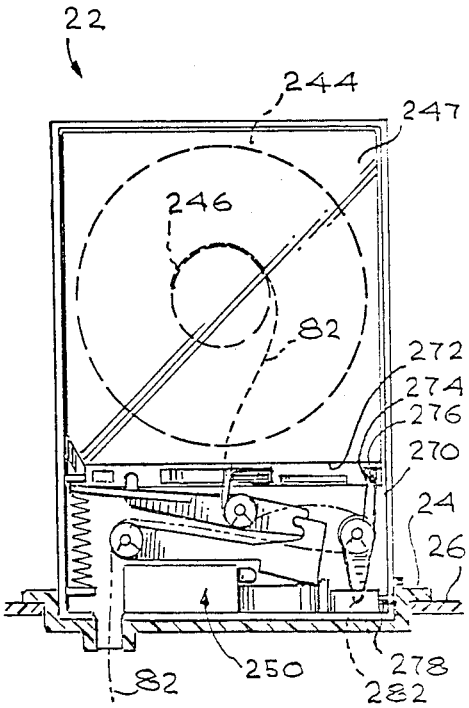
FIG. 17 is a side elevational view of the cassette inserted in the top of the processor.

FIG. 17 is a side elevational view of the cassette 22 inserted in the cassette retainer 24 (represented in fragmentary portions) in the top 26 of the processor 20 (FIG. 1). When the cassette 22 is inserted into the cassette retainer 24, the plunger means 278 engages the side of the cassette retainer 24 and is pushed inside the cassette. This action moves the slot 282 in the plunger means 278 further inside the cassette 22 rotating the enable link 270 until the first end 274 moves over the slot 276 in the bottom 272 of the cartridge 247. The cartridge 247 may now physically move down against the trigger link 266 releasing the blade.

Figure 18:
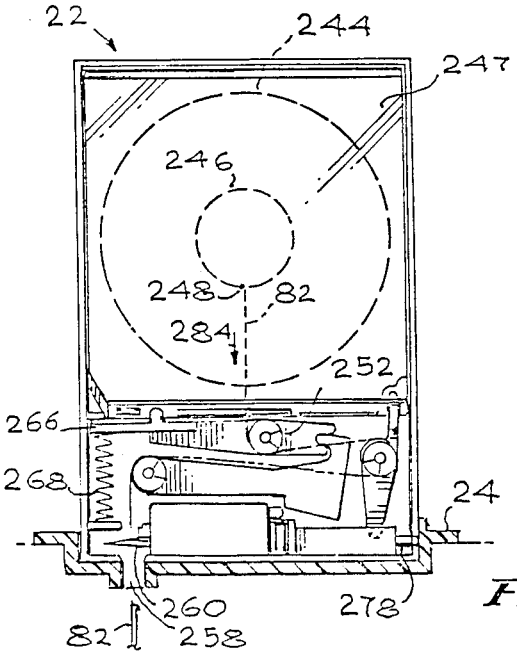
FIG. 18 is a side elevational view of the cassette after cutting the film.

FIG. 18 is a side elevational view of the cassette 22 after the cartridge 247 has moved down against the trigger link 266 releasing the blade 260 and cutting the film 82. The film 82 is only cut when the film remaining on the supply reel 244 reaches the inner end 248. Only then does the film drive module draw the film 82 down in a straight line toward the first capstan 252 as indicated by the arrow 284 with sufficient force to overcome the force of the trigger link biasing means 268 pushing in the opposite direction.

Once the blade 260 has been released, the force on the plunger means 278 provided by the blade biasing means 264 (FIG. 19) is significantly diminished because of the movement of the blade 260 across the cassette slot 258. The force of the plunger means 278 against the cassette retainer 24 is thereby. substantially released permitting the easy removal of the cassette 22 from the retainer 24.

In view of the above, it may be seen that a roll film processor is provided that significantly improves and facilitates the developing of roll film. Of course, the structure may be variously implemented and variously used depending upon specific applications. Accordingly, the scope hereof shall not be referenced to the disclosed embodiments, but on the contrary, shall be determined in accordance with the claims as set forth below.

We claim:

1. A roll film processor for processing film having two edges and wound into a roll, comprising:

a plurality of substantially aligned tanks, each for containing a liquid; and a film drive module defining an essentially serpentine film path including successive "U" shaped sections depending from a common frame member, each of said "V" shaped sections intended to extend into a different one of said tanks for subjecting said roll film to said liquid in said tank and including continuous opposed "V" shaped grooves defining a track for guiding said roll film by said two edges along said film path including a down path leg for carrying said film into said tank and an up path leg for carrying said film out of said tank, said film drive module removable as a unit from said plurality of substantially aligned tanks and including a film mover means positioned entirely outside said liquid for moving said film.

2. The roll film processor according to claim 1 wherein said film has two sides and said film mover means includes at least one pair of opposing rollers, one of said pair of opposing rollers contacting one of said two sides of said film and the other of said pair of opposing rollers contacting the other of said two sides of said film as said film passes between said at least one pair of opposing rollers.

3. The roll film processor according to claim 1 wherein said film drive module further includes an oscillating paddle agitator in at least one of said "U" shaped sections between said down and up path legs, said paddle agitator having an agitator drive means positioned entirely out of said liquid.

4. The roll film processor according to claim 3 wherein said paddle agitator is mounted on an axle positioned above said liquid and has a paddle portion for extending into said liquid.

5. The roll film processor according to claim 1 wherein said removable film drive module includes:

a front portion having one of said "V" shaped grooves; and a rear portion having the other of said "V" shaped grooves;

whereby separation of said front portion from said rear portion provides access to said film when said film is located in said removable film drive module.

6. A roll film processor for processing film having two sides and two edges wound into a roll, comprising:

a plurality of substantially aligned tanks, each for containing a liquid;

a removable film drive module defining an essentially serpentine film path having:

successive "U" shaped sections depending from a common frame member, each of said "U" shaped sections intended to extend into a different one of said tanks and including a down path leg for carrying said film into said tank and an up path leg for carrying said film out of said tank;

opposed "V" shaped grooves defining a track for guiding said two edges of said film along said film path;

a film mover means positioned outside said liquid for moving said film, said film mover means having at least one pair of opposing rollers, one of said pair of opposing rollers contacting one of said two sides of said film and the other of said pair of opposing rollers contacting the other of said two sides of said film as said film passes between said at least one pair of opposing rollers; and an anti-contamination means in at least one of said "U" shaped sections for slowing the mixing of said liquid adjacent said down path leg with said liquid adjacent said up path leg.

7. The roll film processor according to claim 6 wherein said film drive module further includes a paddle agitator in at least one of said "U" shaped sections between said down and up path legs for mixing said liquid.

8. The roll film processor according to claim 7 wherein said paddle agitator has an agitator drive means positioned out of said liquid.

9. A roll film processor for processing film wound into a roll, comprising:

a plurality of substantially aligned tanks, each for containing a liquid;

a removable film drive module defining an essentially serpentine film path including successive "U" shaped sections depending from a common frame member, each of said "U" shaped sections intended to extend into a different one of said tanks and including a down path leg for carrying said film into said tank and an up path leg for carrying said film out of said tank, said film drive module including a film mover means positioned outside said liquid for moving said film; and a slipping reversable take-up reel drive having:

a clockwise fixed speed drive;

a counterclockwise fixed speed drive;

a reel shaft for holding a take-up reel; and a movable slip drive means for rotating said reel shaft and selectively engaging and slipping against one of said clockwise and counterclockwise fixed speed drives.

10. A roll film processor for processing film having two sides and two edges wound into a roll, comprising:

a plurality of substantially aligned tanks, each for containing a liquid;

a removable film drive module defining an essentially serpentine film path having:

successive "U" shaped sections depending from a common frame member, each of said "U" shaped sections intended to extend into a different one of said tanks and including a down path leg for carrying said film into said tank and an up path leg for carrying said film out of said tank;

a film mover means positioned outside said liquid for moving said film, said film mover means having at least one pair of opposing rollers, one of said pair of opposing rollers contacting one of said two sides of said film and the other of said pair of opposing rollers contacting the other of said two sides of said film as said film passes between said at least one pair of opposing rollers;

opposed "V" shaped grooves defining a track for guiding said two edges of said film along said film path;

a front portion having one of said "V" shaped grooves;

a rear portion having the other of said "V" shaped grooves; and a plurality of retainer pins and a plurality of retainer clips for selectively holding said front and rear portions together, each of said plurality of retainer pins coupled to one of said front and rear portions, and each of said plurality of retainer clips selectively coupled to the other of said front and rear portions and to one of said plurality of retainer pins;

whereby separation of said front portion from said rear portions provides access to said film when said film is located in said removable film drive module.

11. The roll film processor according to claim 10 wherein each of said plurality of retainer clips has a finger grip means permitting removal and installation of said retainer clip on one of said plurality of retainer pins by hand.

12. The roll film processor according to claim 11 wherein:

each of said plurality of retainer pins has a pin axis and a pin outer surface;

said retainer clip has:

a body member having first and second ends and a clip axis through said first and second ends perpendicular to said pin axis when said clip is installed on said retainer pin;

two compression shoulders coupled to said first end and spaced from said clip axis defining a clip opening along said clip axis for gripping said pin outer surface; and said finger grip means includes a thumb tab coupled to said second end perpendicular to said clip axis.

13. A roll film processor for processing film having two sides and two edges wound into a roll, comprising:

a plurality of substantially aligned tanks, each for containing a liquid;

a removable film drive module defining an essentially serpentine film path having:

successive "U" shaped sections depending from a common frame member, each of said "U" shaped sections intended to extend into a different one of said tanks and including a down path leg for carrying said film into said tank and an up path leg for carrying said film out of said tank;

a film mover means positioned outside said liquid for moving said film, said film mover means having at least one pair of opposing rollers, one of said pair of opposing rollers contacting one of said two sides of said film and the other of said pair of opposing rollers contacting the other of said two sides of said film as said film passes between said at least one pair of opposing rollers;

opposed "V" shaped grooves defining a track for guiding said two edges of said film along said film path;

a front portion having one of said "V" shaped grooves;

a rear portion having the other of said "V" shaped grooves, whereby separation of said front portion from said rear portion provides access to said film when said film is located in said removable film drive module;

a drive shaft for rotating said at least one pair of oppcsing rollers; and a drive shaft rotating means for rotating said drive shaft having:

a coupler for selectively coupling to said drive shaft; and latitudinally flexible mounting means for normally holding said coupler in a central position and permitting said coupler to couple with said drive shaft at positions away from said central position.

14. A roll film processor for processing film wound into a roll, comprising:

a plurality of substantially aligned tanks, each for containing a liquid;

a removable film drive module defining an essentially serpentine film path including successive "U" shaped sections depending from a common frame member, each of said "U" shaped sections intended to extend into a different one of said tanks and including a down path leg for carrying said film into said tank and an up path leg for carrying said film out of said tank, said film drive module including a film mover means positioned outside said liquid for moving said film;

a motor;

a film dryer means;

a liquid heater means for heating said liquid in at least one of said tanks;

a cover enclosing said motor, said film dryer means, and said tanks; and a single air moving means for cooling said motor, moving air for said film dryer means, and cooling said tanks.

15. A roll film processor for processing film wound into a roll, comprising:

a plurality of substantially aligned tanks, each for containing a liquid;

a removable film drive module defining an essentially serpentine film path including successive "U" shaped sections depending from a common frame member, each of said "U" shaped sections intended to extend into a different one of said tanks and including a down path leg for carrying said film into said tank and an up path leg for carrying said film out of said tank, said film drive module including a film mover means positioned outside said liquid for moving said film;

a cartridge having a supply reel;

said film having an inner end coupled to said supply reel; and a film cutter for cutting said film from said supply reel when said film drive module draws said film off said supply reel to said inner end having:

a blade;

a blade biasing means normally urging said blade against said film;

a trigger link selectively retaining said blade away form said film in a cocked position and supporting said supply reel; and a trigger link biasing means normally retaining said blade in said cocked position and releasing said blade from said cocked position when the force of said film drive module drawing said film exceeds the force of said trigger link biasing means retaining said trigger link in said cocked position.

16. The film roll processor according to claim 15 and further including:

a cassette having said film cutter and for holding said supply reel;

a cassette retainer for selectively retaining said cassette; and said cassette further includes an enable link means prohibiting movement of said blade from said cocked position when said cassette is outside said cassette retainer.

17. The film roll processor according to claim 15 and further including:

a cassette having said film cutter and for holding said supply reel;

a cassette retainer for selectively retaining said cassette; and said cassette further includes a plunger means normally biased outside said cassette to engage said cassette retainer when said blade is in said cocked position and substantially releasing the force of said plunger means on said cassette retainer when said blade is released from said cocked position.

* * * * *